US009823018B2

(12) United States Patent
Parker

(10) Patent No.: US 9,823,018 B2
(45) Date of Patent: Nov. 21, 2017

(54) HEATED SHELF APPARATUS AND FREEZE DRY CART USING SAME

(71) Applicant: Robert M. Parker, Pulaski, WI (US)

(72) Inventor: Robert M. Parker, Pulaski, WI (US)

( * ) Notice: Subject to any disclaimer, the term of this patent is extended or adjusted under 35 U.S.C. 154(b) by 0 days.

(21) Appl. No.: 14/878,824

(22) Filed: Oct. 8, 2015

(65) Prior Publication Data

US 2016/0102911 A1 Apr. 14, 2016

Related U.S. Application Data

(60) Provisional application No. 62/071,962, filed on Oct. 8, 2014.

(51) Int. Cl.
*F26B 5/06* (2006.01)
*F26B 5/04* (2006.01)

(52) U.S. Cl.
CPC ..... *F26B 5/06* (2013.01); *F26B 5/044* (2013.01)

(58) Field of Classification Search
CPC .. F26B 5/06; F26B 5/055; F26B 5/044; F26B 5/04
USPC ..... 34/92
See application file for complete search history.

(56) References Cited

U.S. PATENT DOCUMENTS 1,416,793 A 5/1922 Cox
3,118,742 A 1/1964 McNair Dalgleish et al.
3,132,930 A * 5/1964 Abbott ..... A23L 3/44 104/35
3,289,314 A 12/1966 Porta
3,298,108 A 1/1967 Seffinga
3,394,469 A 7/1968 Eilenberg et al.
3,448,556 A 6/1969 Taggart
3,451,189 A 6/1969 Taggart
3,883,958 A 5/1975 Filipe
4,203,486 A * 5/1980 Rubbright ..... A47J 39/006 165/267
5,404,935 A * 4/1995 Liebermann ..... A21B 1/10 165/48.1
5,546,678 A * 8/1996 Dhaemers ..... D06F 58/10 34/224
6,935,049 B2 * 8/2005 Alstat ..... F26B 5/06 34/288
7,624,514 B2 * 12/2009 Konabe ..... F26B 3/205 34/86
8,582,274 B2 * 11/2013 Kamimura ..... H01L 21/67109 361/234
2015/0128446 A1 5/2015 Ling
(Continued)

FOREIGN PATENT DOCUMENTS

WO WO 2016057848 A1 * 4/2016 ..... F26B 5/044

*Primary Examiner* — Stephen M Gravini
(74) *Attorney, Agent, or Firm* — Russ Weinzimmer & Associates, PC

(57) ABSTRACT

A freeze-drying system is disclosed which includes a vented cart configured for operation in a pressure-controlled chamber, and a plurality of heated shelves disposed in the vented cart. At least one heated shelf of the plurality of heated shelves is provided. The heated shelf includes a first planar sheet formed from a thermally conductive material having a top configured to conduct heat to a tray resting on the top, a second planar sheet disposed opposite the first planar sheet, and a heating element secured between the first and second planar sheets. The heating element has a surface disposed in thermally conductive contact with the first planar sheet.

10 Claims, 6 Drawing Sheets

(56) References Cited

U.S. PATENT DOCUMENTS

2016/0102911 A1* 4/2016 Parker ..... F26B 5/06
34/92
2016/0347055 A1* 12/2016 Yamaguchi ..... B41J 2/1433

* cited by examiner

HEATED SHELF APPARATUS AND FREEZE DRY CART USING SAME

CROSS-REFERENCE TO RELATED APPLICATIONS

The present application claims priority to Provisional Application Ser. No. 62/071,962, filed Oct. 8, 2014, and titled "HEATED PAN LOCKING MECHANISM-HEATER ENVELOPE ASSEMBLY," which is incorporated herein by reference in its entirety.

FIELD

This disclosure relates generally to freeze-drying equipment, and more particularly to heating components for use in a freeze drying system.

BACKGROUND

Freeze-drying is a dehydration process typically used to preserve a perishable material or make the material more convenient for transport. Freeze-drying works by freezing the material and then reducing the surrounding pressure to allow the frozen water in the material to sublimate directly from the solid phase to the gas phase.

Generally stated, there are four stages in the complete freeze drying process: pretreatment, freezing, primary drying, and secondary drying. On a larger scale, freezing is usually done using a freeze-drying machine. In this step, the material is cooled below its triple point, the lowest temperature at which the solid and liquid phases of the material can coexist. This ensures that sublimation rather than melting will occur in the subsequent steps. Larger crystals are easier to freeze-dry.

During the primary drying phase, the pressure is lowered (to the range of a few millibars), and enough heat is supplied to the material for the ice to sublime. The amount of heat necessary can be calculated using the sublimating molecules' latent heat of sublimation. In this initial drying phase, about 95% of the water in the material is sublimated. This phase may be slow, because, if too much heat is added, the material's structure could be altered.

In this phase, pressure is controlled through the application of partial vacuum. The vacuum speeds up the sublimation, making it useful as a deliberate drying process. Furthermore, a cold condenser chamber and/or condenser plates provide a surface(s) for the water vapor to re-solidify on. This condenser plays no role in keeping the material frozen; rather, it prevents water vapor from reaching the vacuum pump, which could degrade the pump's performance. Condenser temperatures are typically below −50° C. (−60° F.).

The secondary drying phase aims to remove unfrozen water molecules, since the ice was removed in the primary drying phase. This part of the freeze-drying process is governed by the material's adsorption isotherms. In this phase, the temperature is raised higher than in the primary drying phase, and can even be above 0° C., to break any physico-chemical interactions that have formed between the water molecules and the frozen material. Usually the pressure is also lowered in this stage to encourage desorption (typically in the range of microbars, or fractions of a pascal).

In many commercial freeze-drying operations, the items that are to be freeze-dried are placed in a cart having shelves configured to support the items. The carts are moved into a freeze-drying chamber, where the ambient pressure is controlled throughout the process. During primary and/or secondary drying, the heat is provided to the items mainly by conduction or radiation. The convection effect is negligible during these drying cycles due to the low air density. Accordingly, the carts and/or shelves may be fitted with heating elements to provide the conductive and/or radiative heat. In large-scale freeze-drying operations, the equipment, particularly the heating elements, may be fragile and easily come loose to cause a reliability and safety hazard

SUMMARY

A general aspect of the invention is a freeze-drying system including: a vented cart configured for operation in a pressure controlled chamber; and a plurality of heated shelves disposed in the vented cart. At least one heated shelf of the plurality of heated shelves includes: a first planar sheet formed from a thermally conductive material and having a top configured to conduct heat to a tray when the tray is resting on the first planar sheet; a second planar sheet disposed opposite the first planar sheet; and a heating element secured between the first planar sheet and the second planar sheet, the heating element having a surface disposed in thermally conductive contact with the first planar sheet.

In some embodiments, the heating element is secured to the second planar sheet of the at least one heated shelf. In further embodiments, the heating element is secured to the second planar sheet of the at least one heated shelf by a thermally conductive adhesive.

In some embodiments, the second planar sheet of the at least one heated shelf is formed from a thermally conductive material, and wherein the heating element is disposed in thermally conductive contact with the second planar sheet.

In some embodiments, the vented cart includes a pair of opposed sidewalls, each having a plurality of rails respectively associated with each of the plurality of heated shelves. In further embodiments, at least one sidewall of the pair of opposed sidewalls includes an opening disposed proximate to one or more opposed rails supporting the at least one heated shelf for receiving an electrical cord associated with the at least one heated shelf.

In some embodiments, the first planar sheet and second planar sheet of the at least one heated shelf engage one another at a side portion to form a grooved interconnecting structure. In further embodiments, the grooved interconnecting structure at the side portion engages a pair of respective rails to secure the at least one heated shelf within an interior of the vented cart.

In some embodiments, the first planar sheet and second planar sheet of the at least one heated shelf engage one another at a first side portion to form a first grooved interconnecting structure, and at a second side portion to form a second grooved interconnecting structure, wherein the first and second grooved interconnecting structures secure the first planar sheet with the second planar sheet to hold the heating element therebetween. In further embodiments, at least one of the first or second grooved interconnecting structures engages a corresponding portion of a pair of respective rails to secure the at least one heated shelf within an interior of the vented cart.

Another general aspect of the invention is a cart configured for operation within a pressure controlled freeze-drying chamber, the cart including: first and second opposed sidewalls; a top wall extending between the first and second opposed sidewalls; a bottom wall extending between the first and second opposed sidewalls; a rear wall extending between the first and second opposed sidewalls, the top wall, and the bottom wall, wherein the rear wall, first and second opposed sidewalls, the top wall, and the bottom wall, define a processing chamber that is configured for venting to ambient atmosphere when placed within a pressure controlled dry-freeze chamber; a plurality of rails disposed in pairs in the processing chamber proximate the first and second opposed sidewalls; and a plurality of heated shelves disposed between and supported by respective pairs of the plurality of rails, wherein at least one heated shelf of the plurality of heated shelves includes a sandwiched arrangement having a heating element secured between a first planar sheet and a second planar sheet, wherein the first planar sheet is formed from a thermally conductive material and is configured to conductively transfer heat from the heating element to a tray when the tray is resting on the first planar sheet.

In some embodiments, the first planar sheet of the at least one heated shelf is formed from a thermally conductive material and includes a top configured to support a tray. In further embodiments, the heating element of the at least one heated shelf includes an upper surface disposed in thermally conductive contact with the first planar sheet.

In some embodiments, the heating element is secured to the second planar sheet of the at least one heated shelf. In further embodiments, the heating element is secured to the second planar sheet of the at least one heated shelf by a thermally conductive adhesive.

In some embodiments, the second planar sheet of the at least one heated shelf is formed from a thermally conductive material, and wherein the heating element is disposed in thermally conductive contact with the second planar sheet.

In some embodiments, the at least one heated shelf is supported by a pair of rails disposed at the first and second opposed sidewalls, and wherein at least one of the first and second opposed sidewalls includes an opening disposed proximate the at least one heated shelf to receive a power cord for the heating element therethrough.

In some embodiments, the first planar sheet and second planar sheet of the at least one heated shelf engage one another at a front portion to form a grooved interconnecting structure. In further embodiments, the grooved interconnecting structure at the front portion engages a pair of respective rails to secure the at least one heated shelf within the processing chamber of the cart.

Another general aspect of the invention is a heated shelf for use in a freeze-drying apparatus, where the heated shelf includes: a first planar sheet, the first planar sheet being formed from a thermally conductive material; a second planar sheet; and a heating element, the heating element being secured between the first planar sheet and the second planar sheet, the heating element being configured to transfer heat from the heating element by conduction to a tray resting on the first planar sheet.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
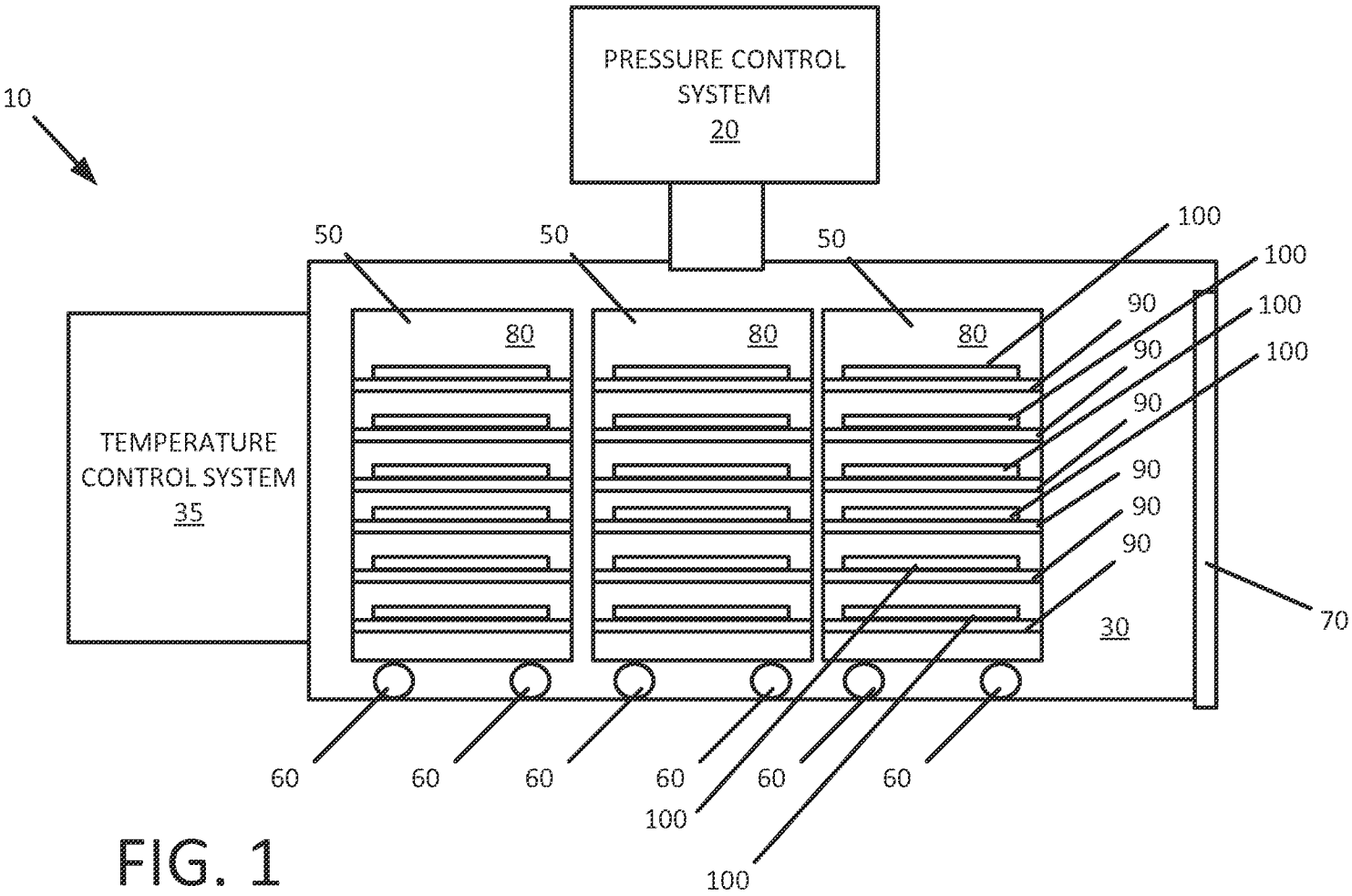
FIG. 1 is a side view illustrating various components of a freeze-drying system.

FIG. 1 is a diagram illustrating various components of a freeze-drying system 10. In this example, the freeze-drying system 10 includes a pressure control system 20 configured to control the pressure within a pressure controlled chamber 30. The temperatures at which the various freeze-drying operations take place is controlled by a temperature control system 35. Both the pressure control system 20 and temperature control system 35 may receive user inputs defining the pressures and temperatures used during the freeze-drying operations.

A plurality of carts 50 are placed inside the pressure controlled chamber 30 to dry freeze items supported within the carts 50. The carts 50 may include wheels 60 to facilitate loading of the carts 50 through a door 70. Once the carts 50 are disposed within the pressure controlled chamber 30, the door 70 is closed to seal the chamber 30. Other structures, in addition to or in lieu of wheels 60, may be provided on the carts 50 to facilitate transport of the carts 50 into the pressure controlled chamber 30. The carts 50 are vented so that the pressure within the pressure controlled chamber 30 is substantially the same as the pressure within the processing chambers 80 of the carts 50.

In FIG. 1, a plurality of heated shelves 90 are supported in each of the processing chambers 80. Each heated shelf 90 is configured to conductively transfer heat to a corresponding tray 100. The items that are to be freeze-dried are placed in the trays 100 for processing. The temperature of the heated shelves 90 can be controlled, for example, by the temperature control system 35.

Figure 2:
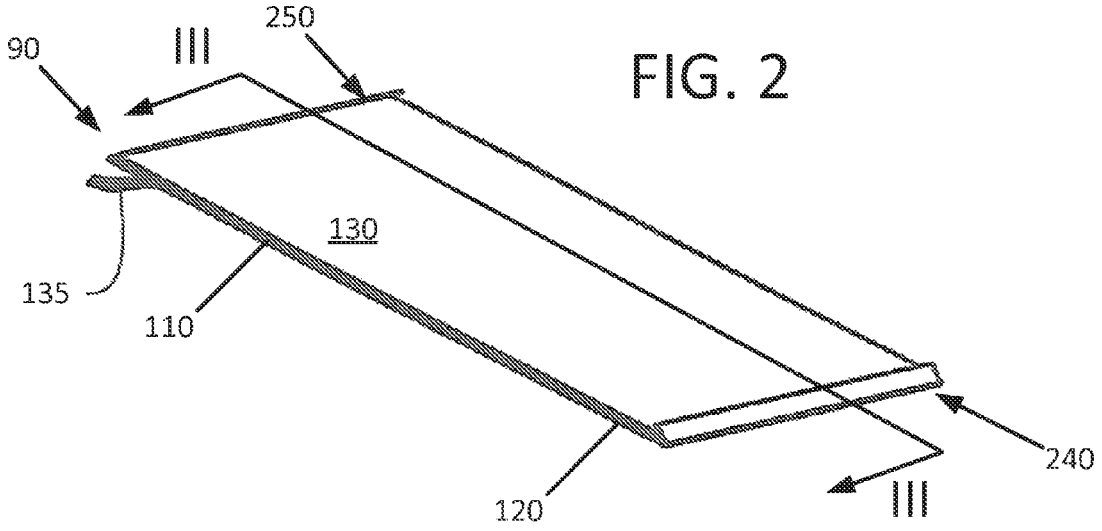
FIG. 2 is a perspective view of one example of a heated shelf that can be used in the freeze-drying system of FIG. 1.
Figure 3:
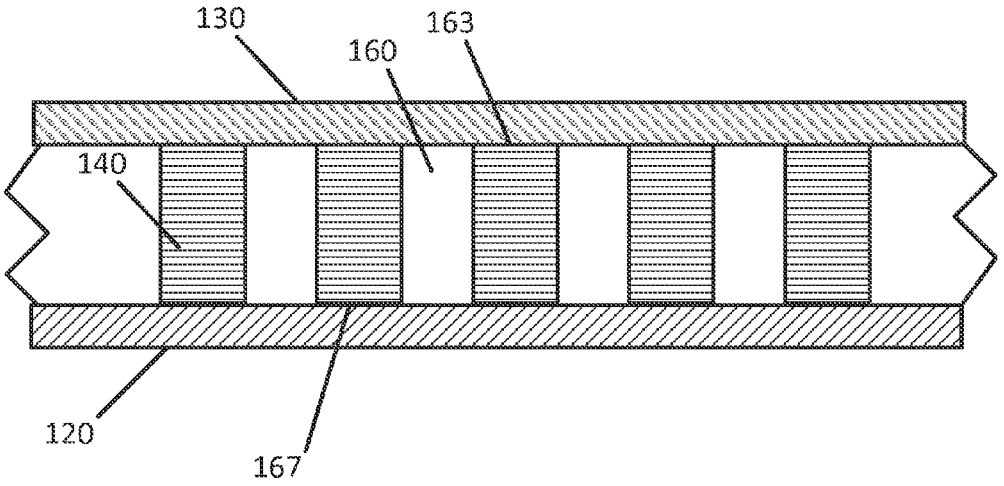
FIG. 3 is a cross-sectional view through line III-III of FIG. 2.
Figure 4:
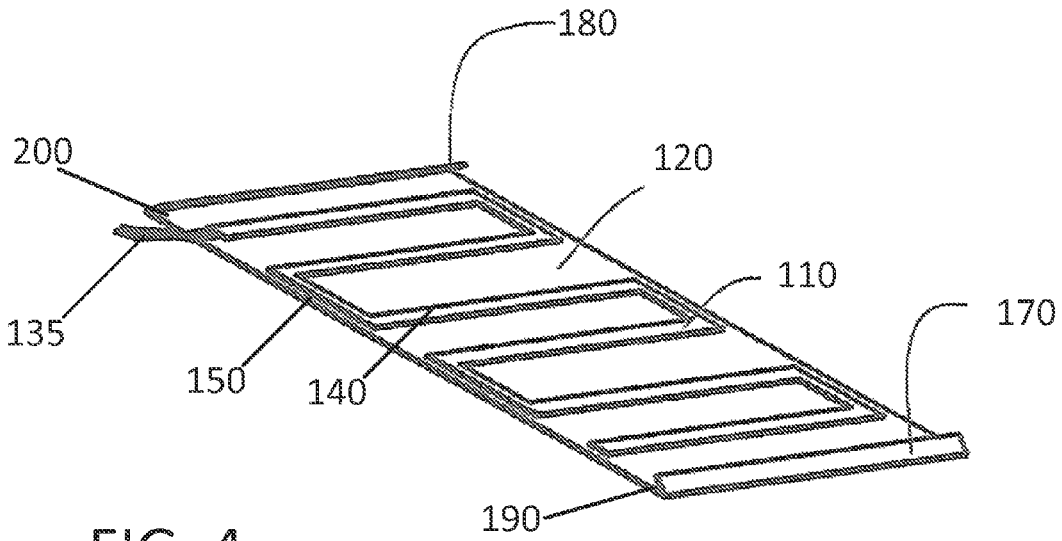
FIG. 4 is a perspective view of the planar sheet of FIG. 2 having lips at right and left portions as well as a heating element disposed on its surface.

FIGS. 2-5 illustrate a heated shelf 90 that can be used in the freeze-drying system 10. In this example, the heated shelf 90 includes a sandwiched arrangement having a heating element 110 disposed between a first planar sheet 120 and a second planar sheet 130. As shown in FIG. 4, the heating element 110 may include a plurality of parallel sections 140 interconnected by a plurality of transverse sections 150. Other regular paths of the heating element 110 are also possible and useful, such as a curving serpentine path. The heating element 110 can extend substantially along the entire width and length of one or both of the first planar sheet 120 and second planar sheet 130. A power cord 135 is connected to the heating element 110 to provide electrical power from a power source.

FIG. 3 is a partial cross-sectional view of the heated shelf 90 taken through line III-III of FIG. 2. As can be seen in FIG. 3, the parallel sections 140 of the heating element 110 are separated by corresponding interstitial regions 160. The interstitial regions 160 can be open and/or filled with a thermally conductive material that provides a heat conducting path for heat generated by the heating element 110 when the carts 50 are subject to low pressure conditions.

The heating element 110 can be secured between the first planar sheet 120 and second planar sheet 130 in a variety of manners. For example, surface 163 of the heating element 110 can be secured to the first planar sheet 120 by a thermally conductive adhesive. Additionally, or in the alternative, surface 167 of the heating element 110 can be secured to the second planar sheet 130 by a thermally conductive adhesive. Either or both of the first planar sheet 120 and second planar sheet 130 can be formed from a thermally conductive material, such as stainless steel. In one example, the first planar sheet 120 is formed from a heat conducting material and is in thermally conductive contact with surface 167 of heating element 110. In a further example, the second planar sheet 130 is also formed from a heat conducting material and is in thermally conductive contact with surface 163 of the heating element 110.

As shown in FIG. 4, the first planar sheet 120 includes a first lip 170 and a second lip 180. The first lip 170 and second lip 180 can each be formed by bending the right and left sections of the first planar sheet 120 back upon themselves to form a right groove 190 and a left groove 200, respectively.

Figure 5:
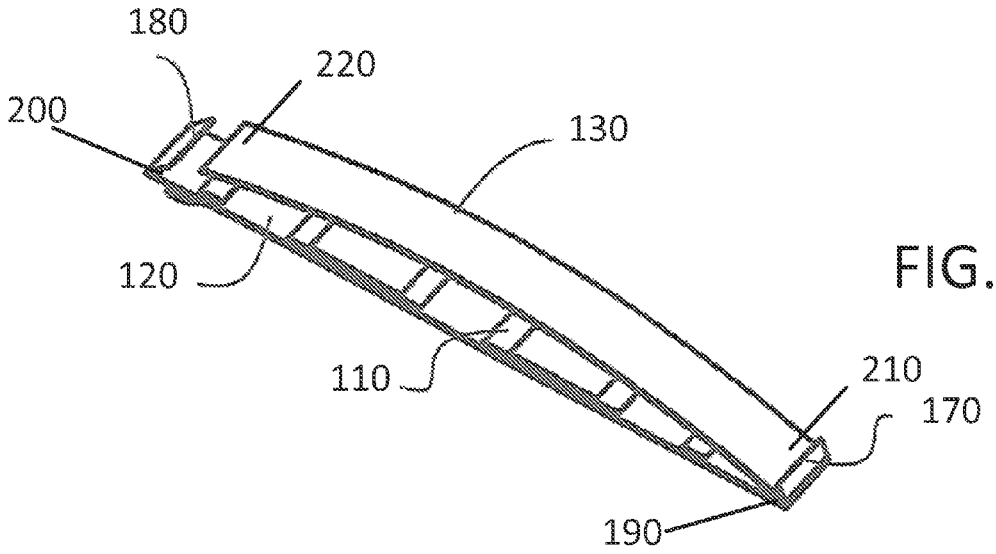
FIG. 5 is a perspective view of the heated shelf of FIG. 2 in an intermediate state of assembly.

The assembly of the first planar sheet 120 with the second planar sheet 130 is illustrated in FIG. 5. In this example, the length of the second planar sheet 130 is slightly less than the distance between the right groove 190 and left groove 200. The second planar sheet 130 may be formed from a ductile material, such as a thin sheet of stainless steel, so that it may be bent to place its front portion 210 within right groove 190 and its rear portion 220 within left groove 200. Once inserted into the grooves, the second planar sheet 130 lies flat with respect to the first planar sheet 120 and heating element 110 and securing the heating element 110 between them. The result is a heated shelf 90 having the sandwiched structure shown in the cross-sectional view of FIG. 3. When assembled in this manner, the heated shelf 90 includes a front grooved interconnecting structure 240 and a rear grooved interconnecting structure 250 (see FIG. 1).

Figure 6:
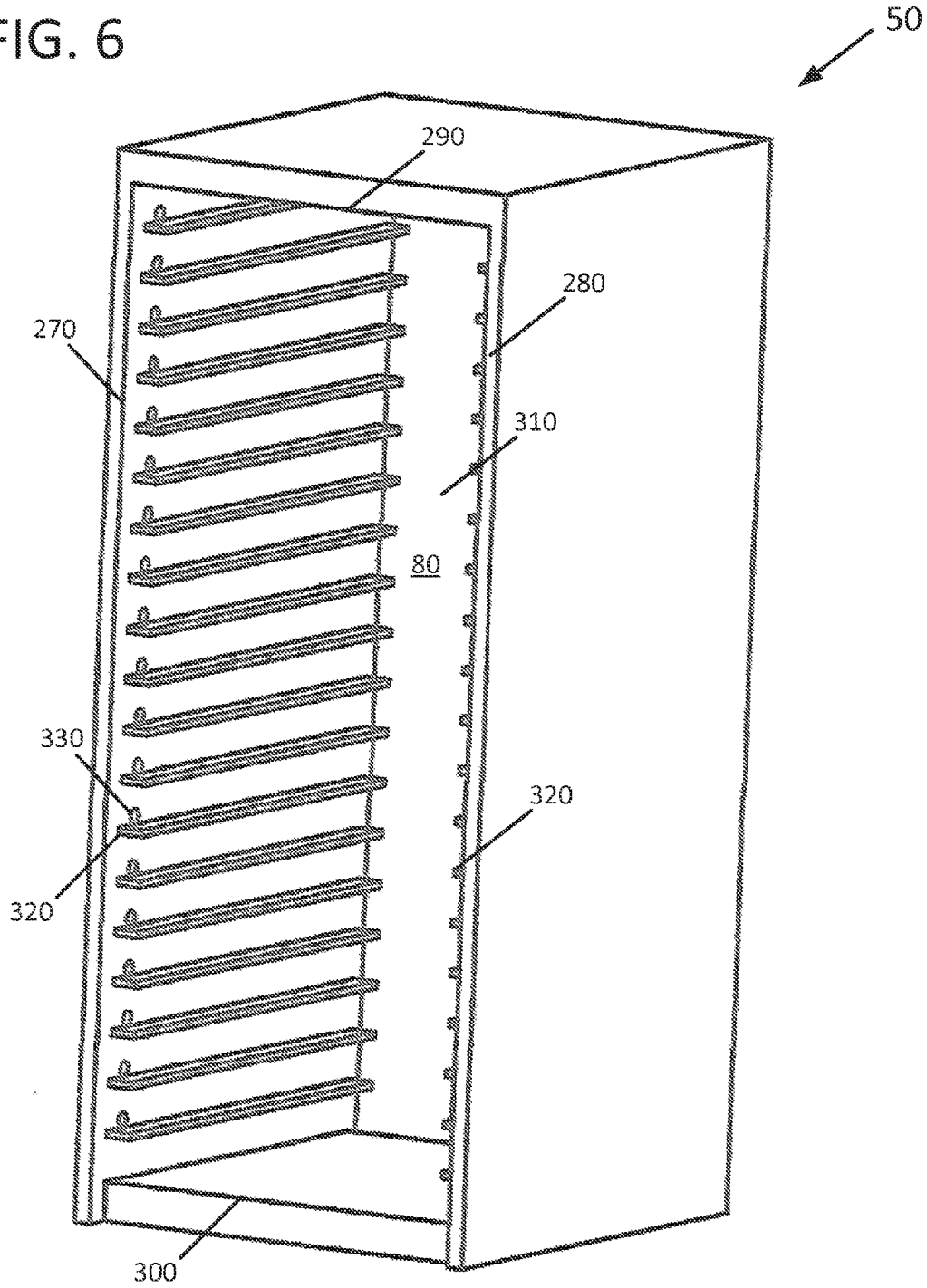
FIG. 6 is a perspective view of one example of a cart that can be used with the heated shelf.

FIG. 6 is a perspective view of one example of a cart 50 that may be used with the heated shelves 90. Here, the cart 50 includes first and second opposed sidewalls 270 and 280. A top wall 290 extends between the first and second opposed sidewalls 270 and 280. Similarly, a bottom wall 300 is disposed opposite the top wall 290 and extends between the first and second opposed sidewalls 270 and 280. A rear wall 310 extends between the first and second opposed sidewalls 270 and 280, as well as between the top wall 290 and the bottom wall 300. A door (not shown) may be disposed over the front opening defined by the front edges of the first and second opposed sidewalls 270 and 280, top wall 290, and bottom wall 300. Together, these structures define a processing chamber 80 that is configured for venting to ambient atmosphere when placed within the pressure controlled chamber 30. For venting purposes, at least one of the walls 270, 280, 290, 300, 310, and/or door may include openings to allow equalization of the pressure within processing chamber 80 with the pressure of the ambient atmosphere of the pressure controlled chamber 30.

The cart 50 also includes a plurality of rails 320 proximate the first and second opposed sidewalls 270 and 280 for supporting the heated shelves 90. Here, the plurality of rails 320 are directly connected to interior surfaces of sidewalls 270 and 280, where they are arranged in pairs having the same elevation to support a respective heated shelf 90. At least one of the opposed sidewalls 270 and 280 includes an opening 330 disposed proximate the location at which the heated shelf 90 is supported by the respective rails 320. The opening 330 is configured to receive the power cord 135 of the corresponding heated shelf 90. In the example of FIG. 6, a plurality of openings 330 are disposed in sidewall 270 proximate a rail of each rail pair. The openings 330 shown in FIG. 6 are formed proximate the opening for the door, although they may be located at other positions.

Figure 7:
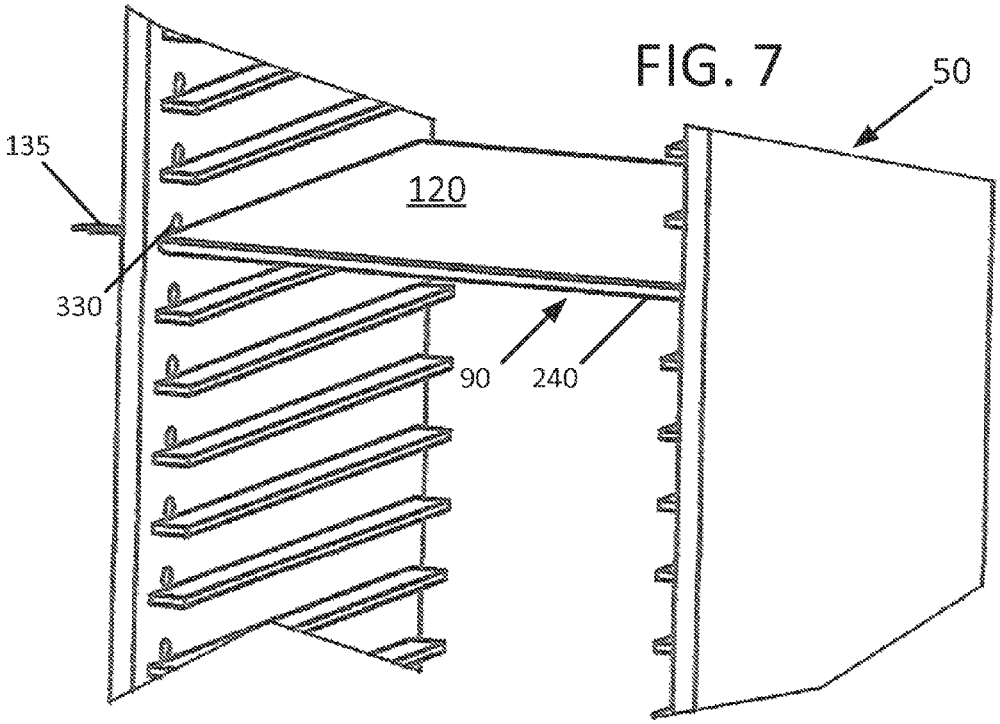
FIG. 7 is a perspective view of the cart in which the heated shelf is disposed on a corresponding set of rails.

FIG. 7 is a perspective view of the cart 50 showing a heated shelf 90 disposed on a corresponding set of rails 320. In this example, the first planar sheet 120 forms the top surface of the heated shelf 90 and the second planar sheet 130 rests against the corresponding set of rails and forms the bottom surface of the heated shelf 90. In this orientation, the right lip 170 of the front grooved interconnecting structure 240 overlies the front portions of the corresponding pair of rails. This forms a structure that facilitates securing the heated shelf 90 to the corresponding rails. The front grooved interconnecting structure 240 may be connected to the front portions of the rails in a variety of different manners. For example, the front grooved interconnecting structure 240 may be secured by welding it to the rails. Additionally, or in the alternative, mechanical fasteners (e.g., screws, bolts, etc.) may be used for the securement. The securement between the front grooved interconnecting structure 240 and the rails may also result in securing the first planar sheet 120 with second planar sheet 130 to hold the heating element 110 between them.

Figure 8:
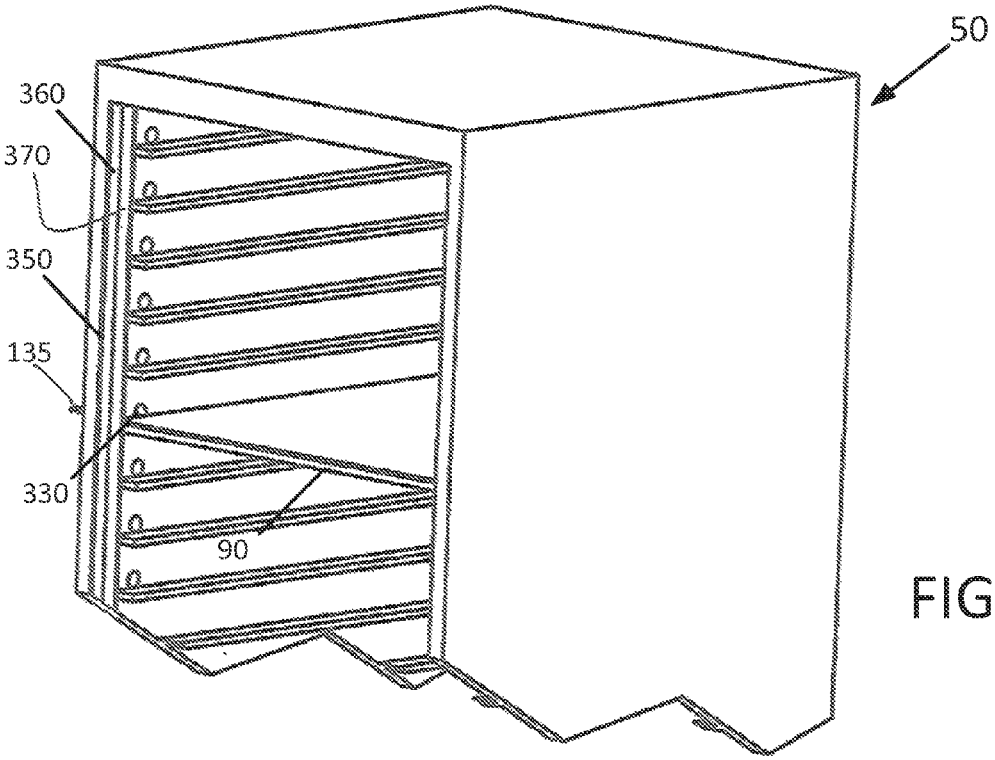
FIG. 8 is a perspective view of the cart including a bracket structure that can be used to further secure the heated shelves within the chamber of the cart and/or protect the power cords of the heated shelves.

FIG. 8 is a perspective view of the cart 50 showing a structure that may be used to further secure the heated shelves 90 against movement within the chamber 80. More particularly, the cart 50 of FIG. 8 includes an angular bracket 350 secured on or near the front portion of the rails proximate sidewall 270. The angular bracket 350 includes a first bracket portion 360 that is secured in fixed relationship with sidewall 270, and a second bracket portion 370 that extends at an angle from the first bracket portion 360. The second bracket portion 370 is secured against the front portions of the heated shelves 90. In this manner, the angular bracket 350 provides a further means for preventing movement of the heated shelves during freeze-drying operations. Among other things, the reduced mobility inhibits chafing of the cords 135.

Figure 9:
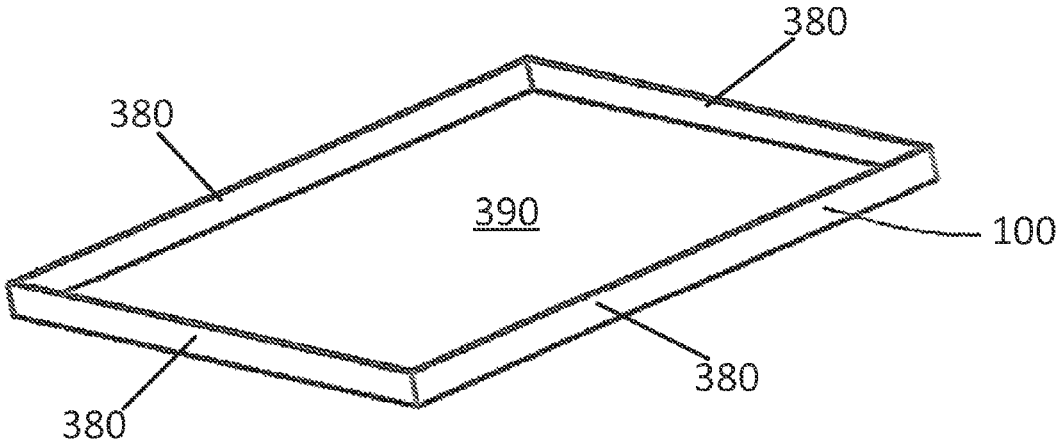
FIG. 9 is a perspective view of one example of a tray that can be placed on the heated shelf and used to hold items that are to be freeze-dried.
Figure 10:
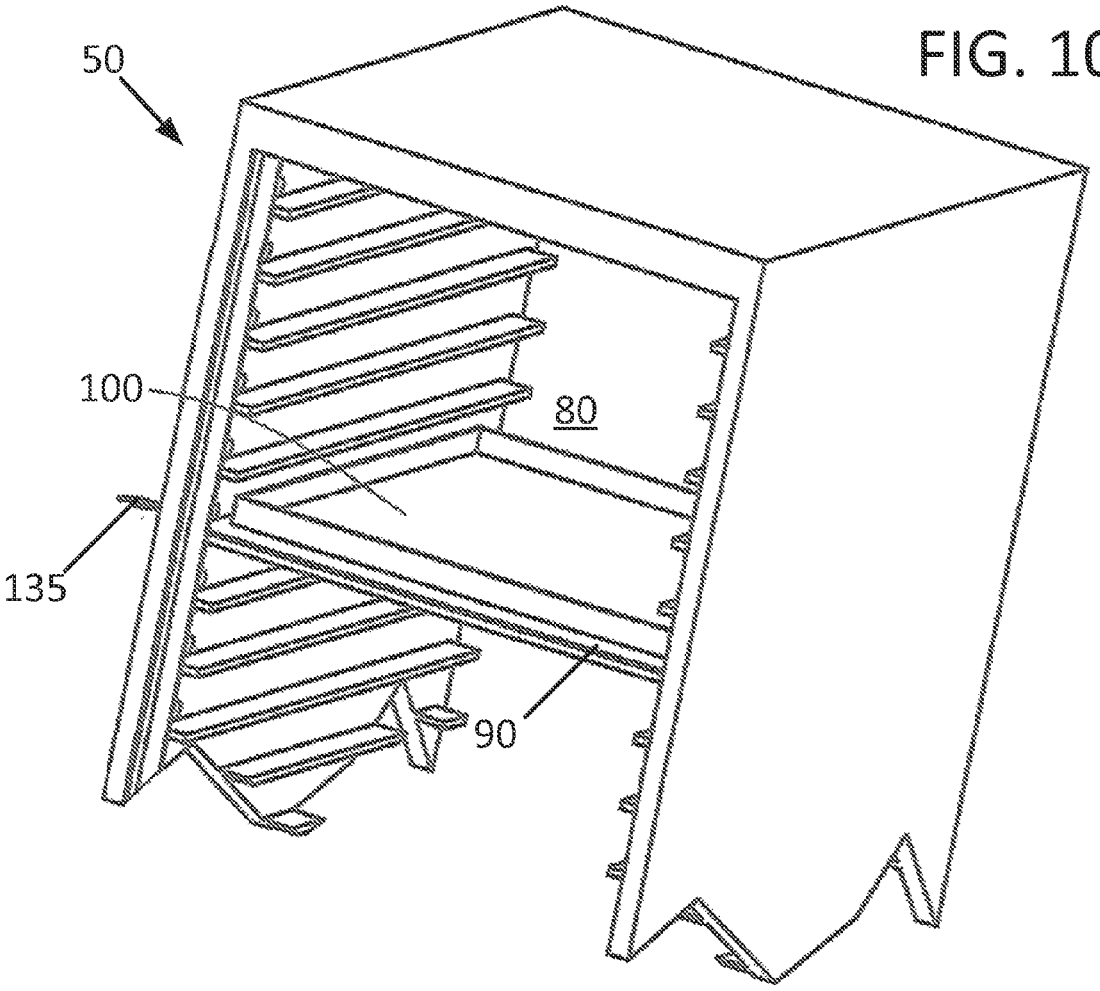
FIG. 10 is a perspective view of the cart showing the tray resting on top of the heated shelf.

FIG. 9 is a perspective view of one example of a tray 100 that may be used to hold the items that are to be freeze-dried. As shown, the tray 100 may include a plurality of upstanding walls 380 forming a rim about a planar pan 390. FIG. 10 is a perspective view of the cart 50 showing the tray 100 inserted into the chamber 80 on top of heated shelf 90.

In the foregoing specification, specific embodiments have been described. However, it is understood that various modifications and changes can be made without departing from the scope of the claims set forth below. Accordingly, the specification and figures are to be regarded in an illustrative rather than a restrictive sense, and all such modifications are intended to be included within the scope of present teachings.

What is claimed is:

1. A freeze-drying system comprising:

a vented cart configured for operation in a pressure controlled chamber of the freeze-drying system; and a plurality of heated shelves disposed in the vented cart, at least one heated shelf of the plurality of heated shelves including:

a first planar sheet formed from a thermally conductive material and having a top configured to conduct heat to a tray when the tray is resting on the first planar sheet;

a second planar sheet disposed opposite the first planar sheet;

a heating element secured between the first planar sheet and the second planar sheet, the heating element having a surface disposed in thermally conductive contact with the first planar sheet; and wherein the plurality of heated shelves are configured for control by a temperature controller of the freeze-drying system.

2. The freeze-drying system of claim 1, wherein the heating element is secured to the second planar sheet of the at least one heated shelf.

3. The freeze-drying system of claim 2, wherein the heating element is secured to the second planar sheet of the at least one heated shelf by a thermally conductive adhesive.

4. The freeze-drying system of claim 1, wherein the second planar sheet of the at least one heated shelf is formed from a thermally conductive material, and wherein the heating element is disposed in thermally conductive contact with the second planar sheet.

5. The freeze-drying system of claim 1, wherein the vented cart includes a pair of opposed sidewalls, each having a plurality of rails respectively associated with each of the plurality of heated shelves.

6. The freeze-drying system of claim 5, wherein at least one sidewall of the pair of opposed sidewalls includes an opening disposed proximate to one or more opposed rails supporting the at least one heated shelf for receiving an electrical cord associated with the at least one heated shelf.

7. The freeze-drying system of claim 1, wherein the first planar sheet and second planar sheet of the at least one heated shelf engage one another at a side portion to form a grooved interconnecting structure.

8. The freeze-drying system of claim 7, wherein the grooved interconnecting structure at the side portion engages a pair of respective rails to secure the at least one heated shelf within an interior of the vented cart.

9. The freeze-drying system of claim 1, wherein the first planar sheet and second planar sheet of the at least one heated shelf engage one another at a first side portion to form a first grooved interconnecting structure, and at a second side portion to form a second grooved interconnecting structure, wherein the first and second grooved interconnecting structures secure the first planar sheet with the second planar sheet to hold the heating element therebetween.

10. The freeze-drying system of claim 9, wherein at least one of the first or second grooved interconnecting structures engages a corresponding portion of a pair of respective rails to secure the at least one heated shelf within an interior of the vented cart.

* * * * *